United States Patent [19]

Stankard

[11] Patent Number: 4,554,796

[45] Date of Patent: Nov. 26, 1985

[54] SPLIT SYSTEM AIR CONDITIONER

[75] Inventor: James M. Stankard, Mentor, Ohio

[73] Assignee: White Consolidated Industries, Inc., Cleveland, Ohio

[21] Appl. No.: 640,544

[22] Filed: Aug. 14, 1984

Related U.S. Application Data

[63] Continuation of Ser. No. 456,819, Jan. 10, 1983, abandoned.

[51] Int. Cl.[4] ..... F25B 27/66

[52] U.S. Cl. ..... 62/326; 62/428; 165/22

[58] Field of Search ..... 62/450, 449, 428, 508, 62/305, 326; 165/122; 219/369, 370, 366

[56] References Cited

U.S. PATENT DOCUMENTS

| | | | |
|---|---|---|---|
| 3,174,541 | 7/1963 | Brant et al. | 165/122 |
| 3,977,467 | 8/1976 | Northrup, Jr. | 62/326 X |
| 4,028,906 | 6/1977 | Gringold et al. | 62/305 X |

*Primary Examiner*—William E. Wayner

*Attorney, Agent, or Firm*—Pearne, Gordon, Sessions, McCoy, Granger & Tilberry

[57] ABSTRACT

A refrigeration compressor and condenser unit is in the form of a rectangular box having opposed, vertical sidewalls and a condenser at one vertical end wall. A fan panel assembly, including a grille, venturi member, fan, and fan motor, is selectively mounted either at the one vertical end position opposite the condenser or on top of the sidewalls parallel to the base. An imperforate closure panel closes off the remaining wall. The fan panel assembly and closure member are interchangeable between the two positions and are fastened to the other walls and to each other by removable fasteners.

6 Claims, 4 Drawing Figures

SPLIT SYSTEM AIR CONDITIONER

This is a continuation of application Ser. No. 456,819, filed on Jan. 10, 1983, now abandoned.

BACKGROUND OF THE INVENTION

This invention relates generally to air conditioning, and more particularly to air conditioning units of the split system type in which the compressor and condenser elements are mounted remotely from the evaporator element, usually in an exterior location.

Air conditioning units for homes and other small buildings have usually been of two types. One type is the unitary room air conditioning unit in which the compressor, condenser and evaporator and necessary fans are mounted in a single unit which is placed either in a window opening or in a separate through-the-wall mounting so that the evaporator units can be used to cool the air inside the building while the condenser is mounted on the outside portion of the unit to discharge the heat into the atmosphere. The other type is the split system in which the evaporator is mounted inside the building, while the compressor and condenser units are then mounted outside at a suitable location. In the case of the split system, the only connection between the units need be the two refrigerant lines and the necessary electrical and control connections for the system. Generally, the unitary room air conditioner units are of smaller size than the split system units and, because of the relatively high capacity of the latter, the condenser unit requires special consideration with regard to noise reduction and air flow because of the larger capacity.

Recently, however, it has been proposed to make relatively small split system units which may be used for cooling only a single room with a single evaporator unit having a size similar to that used in unitary room air conditioners. While the small split system is of greater cost than a room air conditioner unit, it does offer a number of advantages, such as not requiring a window or other large opening for mounting the unit, since the evaporator can be placed against a bare wall and only a relatively small opening through the wall is required for the refrigerant and electrical connections. Furthermore, such a unit, by allowing remote placement of the compressor, condenser and condenser fan, allows a substantial reduction of noise in the room while still providing sufficiently high cooling capacity for relatively large rooms in hot climates. However, such units are still of generally smaller size than central system air conditioners, and do not require the amount of sound muffling and special air flow considerations required for the condenser units of that type.

SUMMARY OF THE INVENTION

The present invention provides a refrigeration unit for a split system air conditioner which is convertible to allow either horizontal or vertical discharge of the air passing through the refrigeration unit. Furthermore, this conversion can be done either at the time of installation or at a later time without affecting the portion of the system charged with refrigerant, and without the addition of other parts, merely by partial disassembly of a portion of the unit and reassembly of the same parts in a different relationship.

According to the preferred embodiment of this invention, the unit consists of a boxlike housing having a bottom panel and a pair of side panels attached thereto.

At one end, the condenser coil unit is mounted integral with a grille and other support members to close off the one end of the rectangular box and is secured to the two side panels. The compressor is mounted within the box and the top and the other end are arranged to be closed off by a plain closure panel and a second panel which includes the fan, venturi, and grille mounted together as a unit. If horizontal discharge is desired, the fan unit panel is mounted as the other end panel, and the closure panel is then placed on the top, whereas, for vertical discharge, the fan unit panel is placed in the top position and the closure panel is placed on the end. The closure panel and the fan unit panel have the same screw-hole arrangement and same dimensions, and are secured to each other and to the side panels. If conversion is desired, for example, from a horizontal discharge to vertical discharge, it is only necessary to remove the sheet metal screws attaching both panels to the side panel and to each other. The fan unit panel is then shifted to the top position with the former bottom edge adjacent the open end. The closure panel is shifted to the side position and rotated 180 degrees so that the edge that was adjacent the top of the fan unit panel remains uppermost adjacent the former bottom edge of the fan unit panel. The wiring to the fan from the internal junction box is made long enough that this movement can occur without disconnecting or reconnecting any of the wires to the fan. Since the refrigerant lines to both the condenser and the compressor are not affected, there is no need to recharge the refrigerant system or make any electrical connections and reconnections when the conversion is made.

DETAILED DESCRIPTION OF THE INVENTION

Figure 3:
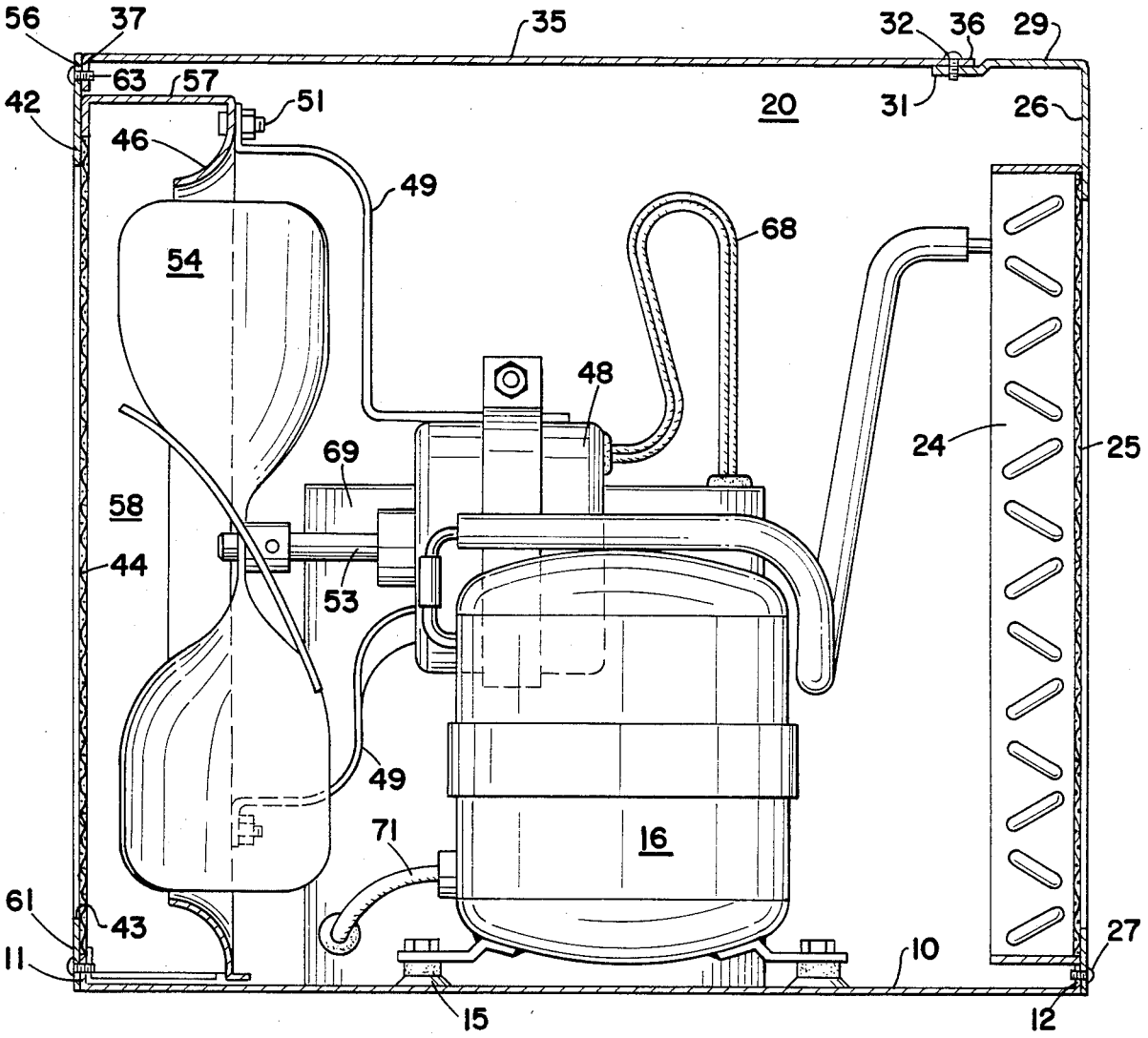
FIG. 3 is a cross-sectional view to the unit arranged for horizontal discharge.

Referring to the figures in greater detail, the refrigeration unit has a housing in the form of a rectangular box which includes a rectangular bottom pan 10 which has upturned lips 11 and 12 on the left and right ends, as shown in FIG. 3, and it will be understood that the other two sides also have upturned lips which are not shown. Formed into the bottom pan 10 are suitable mounting pads 15 which serve to support a hermetic compressor 16.

Figure 1:
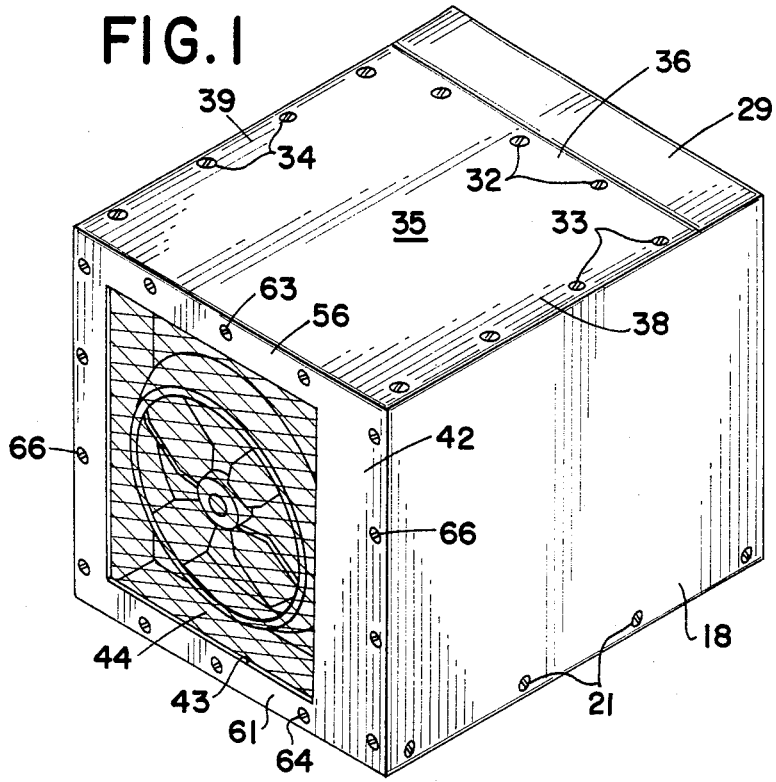
FIG. 1 is a perspective view of the refrigeration unit arranged for horizontal air discharge.
Figure 2:
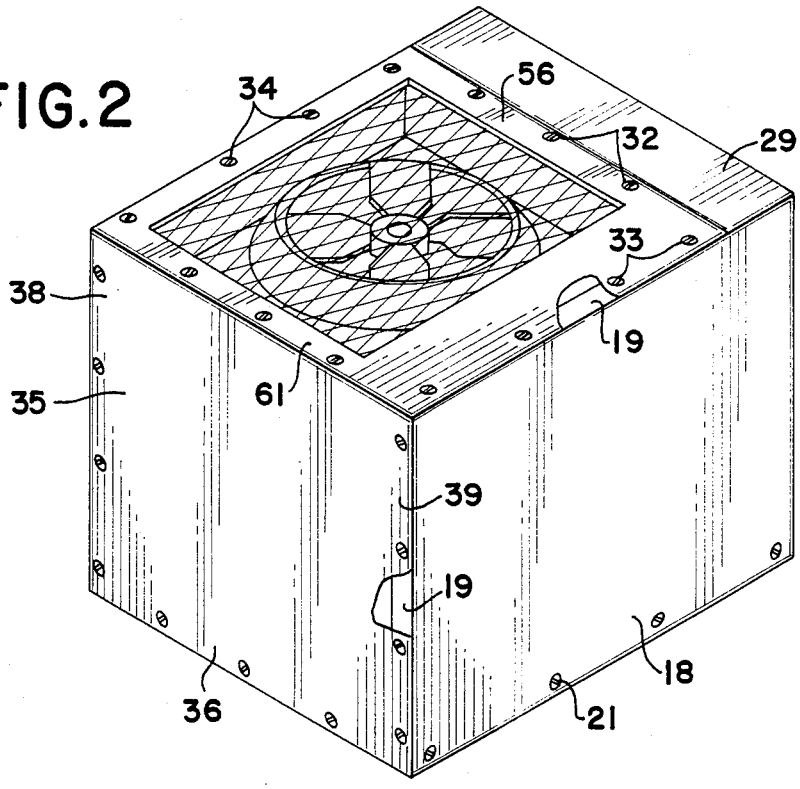
FIG. 2 is a view similar to FIG. 1, with the fan unit arranged for vertical air discharge.
Figure 4:
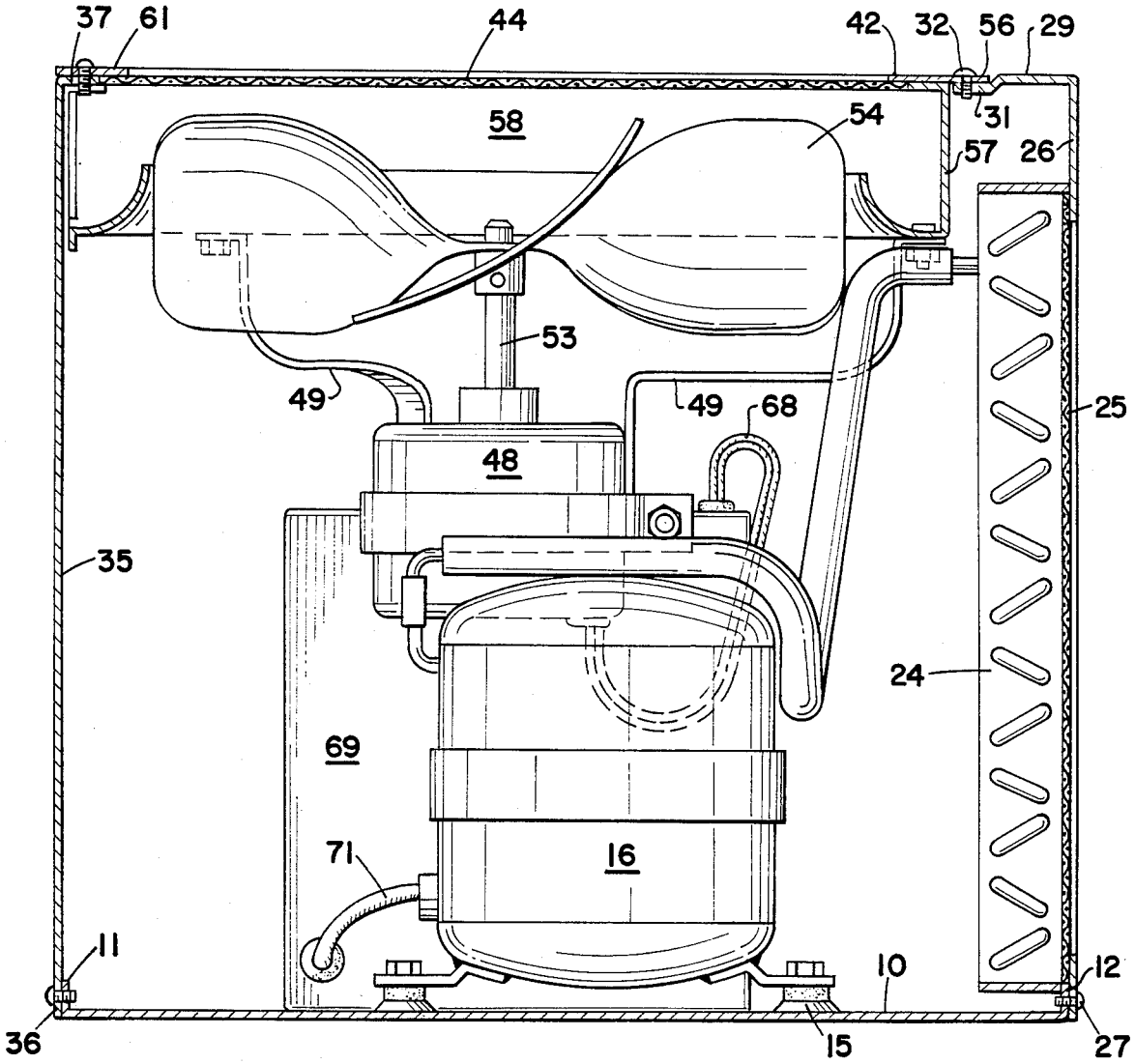
FIG. 4 is a cross-sectional view through the unit rearranged for vertical discharge.

As shown in FIGS. 1 and 2, the housing includes a front, side panel 18 which has inturned lips, such as shown at 19, on the top and two sides, and whose lower edge is secured to the lip on the bottom pan 10 by fasteners such as screws 21. The rear side panel 20 (see FIG. 3) is of similar configuration as the front side panel 18 and is secured to the bottom pan in the same manner. On the right-hand side of the box, as shown in FIGS. 3 and 4, is located the condenser coil 24, which may be of the usual tube and fin variety, together with a grille 25, and both the condenser 24 and grille 25 are secured by suitable means such as welding to a mounting panel 26. Fasteners such as screws 27 secure the panel 26 to the right lip 12 of bottom pan 10, and also to the adjacent lips on the front and rear side panels 18 and 20. The panel 26 has a top panel portion 29 which extends inward a distance from the vertical portion, where it terminates in an offset portion as indicated at 31. As will be pointed out later, the purpose of the top portion 29 is to allow greater width of the unit, if such space is necessary, and the distance from the edge of the top panel portion 29 to the opposite side is equal to the vertical height of the panels.

In the configuration of FIGS. 1 and 3, the top surface of the enclosure is covered by an imperforate closure panel 35 which has an end edge 36 which overlaps the offset portion 31 and to which it is fastened by removable fasteners such as screws, indicated at 32. At the opposite end from the edge 36, the closure panel 35 has a right angle lip 37 extending downward in vertical alignment with the left lip 11 on the bottom pan 10. The front side edge 38 of the closure panel 35 overlaps the front side panel 18 and is fastened to the lips 19 by screws 33, and the other edge 39 is secured to the rear side panel 20 by screws 34.

At the end opposite the condenser 24 there is mounted the fan panel 42, which has a rectangular grille opening 43 therein closed off by a suitable mesh grille 44 welded to the inside surface of the panel. A venturi or shroud member 46 is also welded to the fan panel 42 to define a circular opening and act as a shroud to control air flow around the fan mounted therein. The fan motor 48 is mounted on brackets 49 secured to the venturi member 46 by bolts 51, and the motor 48 has a shaft 53 on which is mounted a multibladed fan 54 positioned within the opening in the venturi member 46. The fan panel 42 has a top edge 56 below which is located a top wall 57 of the venturi member to space that member from the panel. Likewise, the venturi member 46 has sidewalls 58 which extend downward adjacent the bottom pan 10. The three walls, consisting of the top wall 57 and the two sidewalls 58, form a rigid member and allow the bottom portion to be left open so that incoming water from rain or the like may pass directly into the bottom pan 10 from which it may exit by suitable drainholes (not shown).

The fan panel 42 thus, in effect, forms a single unit on which the venturi member and fan motor and fan are all mounted as a unit. Accordingly, the fan panel 42 is fastened by screws 63 along the top edge 56 to the lip edge 37 of the closure panel 35. The bottom edge 61 of the fan panel 42 is fastened by screws 64 to the left lip 11 of the bottom panel 10, and sets of screws 66 along the two sides of the fan panel 42 serve to fasten that panel to the lips 19 on the front and rear side panels 18 and 20.

The fan motor 48 is connected by a length of wire 68 to an electrical box 69 mounted on the rear side panel 20 and suitable wiring 71 is also provided from the electrical box 69 to the compressor 16.

It will therefore be seen that the bottom pan 10, the front and rear side panels 18 and 20, the condenser panel 26, closure panel 35, and fan panel 42 are secured together by a number of screws to form a rigid boxlike enclosure within which are mounted the fan, compressor, and condenser. With the arrangement as shown in FIGS. 1 and 3, when the unit is running, air enters through the condenser 24 into the interior of the enclosure and it is forced outward by the fan 54 through the grille opening 43 and, in this situation, the air flow is in a straight line direction from side to side. On the other hand, if it is desired not to have the horizontal exit of the air, the unit can be converted by interchanging the fan panel 42, together with all of the parts mounted on it, and the closure panel 35 to allow the air to exit at the top, as shown in the arrangement shown in FIGS. 2 and 4.

To make this conversion, it is necessary to remove all of the screws securing the closure panel and the fan panel to the other members and to each other. When this is done, the fan panel and the fan mechanism can be merely rotated in effect about a horizontal axis and put in the position previously occupied by the closure panel 35, and fastened in place by the screws previously indicated at 32, 33, and 34.

The closure panel 35 is now placed on the end, but is rotated 180 degrees so that the lip edge 37 remains at the top and the end edge 36 is now at the bottom adjacent the left lip 11 on the bottom pan 10. The lip edge 37 is placed underneath the edge 61 of the fan panel, and the closure panel is then secured by screws to the left lip 11 on the bottom pan 10 and to the side lips on the front and rear panels 18 and 20, whereas, the bottom edge 61 of the fan panel 42 is then secured to the lip edge 37 of the closure panel. Thus, the two configurations may be had merely by the removal of the two panels and the interchange in positions without the addition or removal of any other parts. By making the wires 68 sufficiently long, the fan motor 48 can be moved with the rest of the panel components between the two positions without disconnecting any electrical connections. Likewise, since the condenser 24 remains in the same position at all times, there is no need to disconnect or change any of the refrigerant lines, and the mounting of the condenser 24 and compressor 16 is not affected by the alteration in the discharge direction of the cooling air.

While a preferred embodiment of the invention has been shown and described in detail, it will be understood that various modifications and rearrangements may be made within the scope of the invention as defined in the following claims.

What is claimed is:

1. A convertible housing for a refrigeration compressor and condenser unit having a compressor, condenser, a motor driven fan, and a fan associated venturi member, said housing comprising a rectangular base, a pair of vertically extending parallel sidewalls extending upwardly from one pair of opposite sides of said base to the top of said unit and defining opposed vertical end wall positions therebetween, the compressor being mounted on said base, the condenser being mounted at one of said end wall positions, a top panel mounted on top of said sidewalls adjacent said condenser and extending a predetermined distance from said condenser toward the other of said end wall positions, an imperforate closure panel, and a fan panel assembly including the venturi member and the motor-driven fan both secured to the fan panel assembly, said closure panel and said fan panel assembly being interchangeably mounted on said sidewalls by removable fasteners in either of two positions, a first of said positions being horizontal on top of said sidewalls and parallel to said base, the second of said positions being the other of said end wall positions, said condenser and compressor unit having fixed exterior dimensions regardless of the relative positions of said interchangeable closure panel and fan panel assembly, said rectangular base always being the lowermost portion of said housing when the housing is in an installed, operating, position.

2. A convertible housing as set forth in claim 1, wherein said fan panel assembly has a first edge on one side and a second edge on the opposite side, said fan panel assembly being located in said first position with said first edge adjacent said condenser, said fan panel assembly being located in said second position with said second edge adjacent said base.

3. A convertible housing as set forth in claim 2, wherein said closure panel has an inturned lip on one side, said closure panel being located in said first position with said lip adjacent said first position with said lip adjacent said first edge of said fan panel assembly in said second position.

4. A convertible housing as set forth in claim 3, wherein said lip is secured to said first edge of said fan panel assembly by removable fasteners.

5. A convertible housing as set forth in claim 3, wherein said closure panel is located in said second position with said lip adjaent the second edge of said fan panel assembly in said first position.

6. A convertible housing as set forth in claim 5, wherein said lip is secured to said second edge of said fan panel assembly by removable fasteners.

* * * * *